US006808600B2

(12) United States Patent
Ross et al.

(10) Patent No.: US 6,808,600 B2
(45) Date of Patent: Oct. 26, 2004

(54) METHOD FOR ENHANCING THE SOFTNESS OF PAPER-BASED PRODUCTS

(75) Inventors: Russell F. Ross, Suwanee, GA (US); Jark C. Lau, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 51 days.

(21) Appl. No.: 10/291,858

(22) Filed: Nov. 8, 2002

(65) Prior Publication Data

US 2004/0089429 A1 May 13, 2004

(51) Int. Cl.[7] ..... D21F 7/00
(52) U.S. Cl. ..... 162/192; 162/109; 162/207
(58) Field of Search ..... 162/109, 111, 162/192, 207, 50; 204/157.15

(56) References Cited

U.S. PATENT DOCUMENTS

| | | | |
|---|---|---|---|
| 2,345,543 | A | 3/1944 | Wohnsiedler et al. |
| 2,926,116 | A | 2/1960 | Keim |
| 2,926,154 | A | 2/1960 | Keim |
| 3,301,746 | A | 1/1967 | Sanford et al. |
| 3,322,617 | A | 5/1967 | Osborne |
| 3,494,821 | A | 2/1970 | Evans |
| 3,556,932 | A | 1/1971 | Coxcia et al. |
| 3,556,933 | A | 1/1971 | Stamford et al. |
| 3,700,623 | A | 10/1972 | Keim |
| 3,772,076 | A | 11/1973 | Keim |
| 3,885,158 | A | 5/1975 | Flutie et al. |
| 3,899,388 | A | 8/1975 | Petrovich et al. |
| 4,129,528 | A | 12/1978 | Petrovich et al. |
| 4,144,370 | A | 3/1979 | Boulton |
| 4,147,586 | A | 4/1979 | Petrovich et al. |
| 4,158,594 | A | 6/1979 | Becker et al. |
| 4,222,921 | A | 9/1980 | Van Eenam |
| 4,529,480 | A | 7/1985 | Trokhan |
| 4,603,176 | A | 7/1986 | Bjorkquist et al. |
| 4,605,702 | A | 8/1986 | Guerro et al. |
| 4,921,034 | A | 5/1990 | Burgess et al. |
| 5,003,178 | A | 3/1991 | Livesay |
| 5,048,589 | A | 9/1991 | Cook et al. |
| 5,163,365 | A | 11/1992 | Taylor |
| 5,284,703 | A | 2/1994 | Everhart et al. |
| 5,399,241 | A | 3/1995 | Oriaran et al. |
| 5,399,412 | A | 3/1995 | Sudall et al. |
| 5,466,337 | A | 11/1995 | Darlington et al. |
| 5,492,598 | A | 2/1996 | Hermans et al. |
| 5,510,001 | A | 4/1996 | Hermans et al. |
| 5,529,665 | A | 6/1996 | Kaun |
| 5,543,067 | A | 8/1996 | Phan et al. |
| 5,558,873 | A | 9/1996 | Funk et al. |

(List continued on next page.)

FOREIGN PATENT DOCUMENTS

| | | |
|---|---|---|
| EP | 0384582 A1 | 8/1990 |
| EP | 0526592 B1 | 2/1993 |
| EP | 0647287 B1 | 4/1995 |
| EP | 0756035 B1 | 1/1997 |
| EP | 0771904 A2 | 5/1997 |
| WO | WO 9748114 A1 | 12/1997 |
| WO | WO 0021918 A1 | 4/2000 |
| WO | WO 0114641 A1 | 3/2001 |
| WO | WO 0131122 A1 | 5/2001 |
| WO | WO 0156756 A1 | 8/2001 |

OTHER PUBLICATIONS

PCT Search Report, Dec 2, 2003.

*Primary Examiner*—Peter Chin
(74) *Attorney, Agent, or Firm*—Dority & Manning, P.A.

(57) ABSTRACT

A method for softening a paper-based product, such as facial tissues, bath tissues, paper towels, etc., is provided. In particular, the method of the present invention includes exposing a cellulosic fibrous material to ionizing radiation (e.g., electron beam radiation). It is believed that the ionizing radiation induces vibrational forces throughout the cellulosic fibrous structure, thereby disrupting hydrogen bonds between adjacent fibers and opening the crystalline structure of the material to result in a softer product.

32 Claims, 4 Drawing Sheets

U.S. PATENT DOCUMENTS 5,589,034 A 12/1996 Hultman et al.
5,591,309 A 1/1997 Rugowski et al.
5,622,786 A 4/1997 Weber et al.
5,667,636 A 9/1997 Engel et al.
5,716,498 A 2/1998 Jenny et al.
5,725,736 A 3/1998 Schroeder et al.
5,730,839 A 3/1998 Wendt et al.
5,830,321 A 11/1998 Lindsay et al.
5,868,904 A 2/1999 Laapotti
5,935,383 A 8/1999 Sun et al.
5,962,995 A 10/1999 Avnery
6,017,417 A 1/2000 Wendt et al.
6,096,412 A 8/2000 McFarland et al.
6,120,640 A 9/2000 Shih et al.
6,129,815 A 10/2000 Larson et al.
6,211,139 B1 4/2001 Keys et al.
6,296,736 B1 10/2001 Hsu et al.
6,315,864 B2 11/2001 Anderson et al.
6,407,492 B1 6/2002 Avnery et al.
6,423,179 B1 * 7/2002 Jardeby et al. ..... 162/111
6,452,679 B1 9/2002 Workman, Jr.
6,736,935 B2 * 5/2004 Hermans et al. ..... 162/109

* cited by examiner

SAMPLE D

SAMPLE A

SAMPLE C

SAMPLE B

METHOD FOR ENHANCING THE SOFTNESS OF PAPER-BASED PRODUCTS

BACKGROUND OF THE INVENTION

Paper-based products, such as paper towels, facial tissues and other similar products, are designed to include several important properties. For example, the products should have good bulk, a soft feel and should be highly absorbent. The product should also have good strength, even when wet, and should resist tearing. Unfortunately, it is very difficult to produce a high strength paper product that is also soft. Usually, when steps are taken to increase one property of the product, other characteristics of the product are adversely affected.

For instance, strength is typically increased by the addition of strength agents to the product. Although the strength of the paper product is increased by such strength agents, the resulting paper product is generally not soft. In particular, cellulosic fibers contain a number of functional groups (e.g., hydroxyl groups, carboxyl groups, etc.) that form hydrogen bonds with adjacent cellulosic fibers. These hydrogen bonds restrict the movement of adjacent cellulosic fibers and thus result in a product that feels relatively stiff. Consequently, paper-based products are conventionally softened using mechanical techniques (e.g., creping) or with chemical debonders. These softening techniques disrupt the hydrogen bonds formed between adjacent cellulosic fibers break, thereby resulting in a web that has improved softness.

Unfortunately, however, conventional softening techniques sometimes result in problems. For example, due to the extensive mechanical forces required during creping, it is often difficult to control the extent of softening and strength reduction. Moreover, the properties of the product may vary for a new creping blade and a used creping blade. In addition, chemical debonders require the incorporation of chemical compounds during paper formation, which may be time consuming and costly in many applications. As such, a need currently exists for an improved method of softening a paper-based product.

SUMMARY OF THE INVENTION

In accordance with one embodiment of the present invention, a method of softening a cellulosic fibrous material is disclosed that comprises exposing the material to ionizing radiation at a dosage of from about 0.1 megarads to about 10 megarads, and in some embodiments, from about 1 megarad to about 5 megarads. The ionizing radiation has a wavelength of from about $10^{-14}$ meters to about $10^{-5}$ meters, and in some embodiments, from about $10^{-13}$ meters to about $10^{-9}$ meters.

In accordance with another embodiment of the present invention, a method is disclosed for softening a paper web that is formed from a papermaking furnish that contains cellulosic fibers and dried to a solids consistency of greater than about 95%. The method comprises exposing the dried paper web to electron beam radiation at a dosage of from about 0.1 to about 10 megarads. In one embodiment, the paper web is dried with a through-dryer. Further, if desired, the paper web may be formed without creping.

Other features and aspects of the present invention are discussed in greater detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
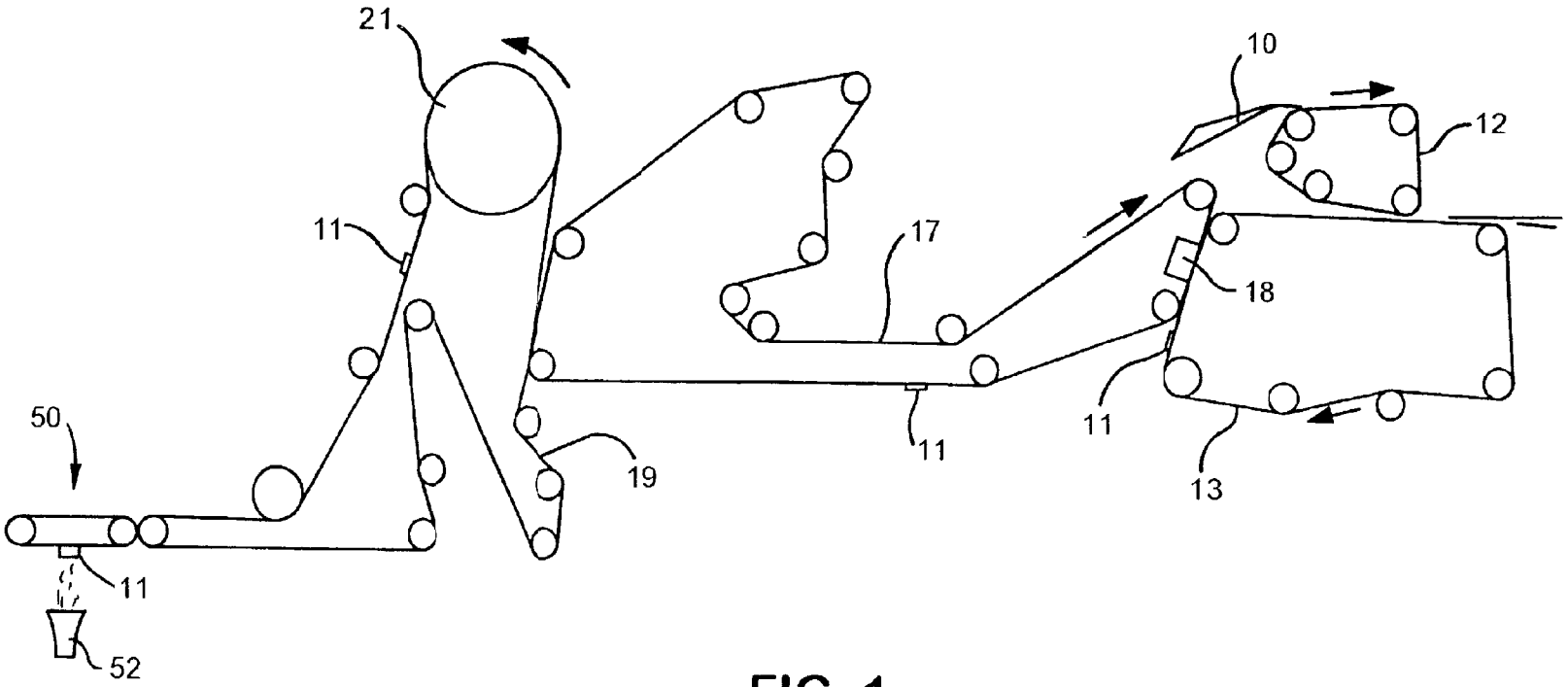
FIG. 1 is schematic diagram of one embodiment for forming a paper web in accordance with the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a method for softening cellulosic fibers for use in a variety of paper-based products, such as facial tissues, bath tissues, paper towels, personal care absorbent articles (e.g., diapers, training pants, absorbent underpants, adult incontinence products, feminine hygiene products), wipers, and the like. In particular, the method of the present invention includes exposing cellulosic fibers to ionizing radiation. The ionizing radiation induces vibrational forces throughout the fibrous structure. Without intending to be limited by theory, it is believed that these vibrational forces cause the relatively weak hydrogen bonds formed between adjacent cellulosic fibers to break. Thus, by reducing the number of hydrogen bonds between adjacent cellulosic fibers, the resulting product is less stiff and generally softer to the touch.

Generally speaking, ionizing radiation is radiation having an energy sufficient to either directly or indirectly produce ions in a medium. Some suitable examples of ionizing radiation that may be used in the present invention include, but are not limited to, electron beam radiation, natural and artificial radio isotopes (e.g., $\alpha$, $\beta$, and $\gamma$ rays), x-rays, neutron beams, positively-charged beams, laser beams, and the like. Electron beam radiation, for instance, involves the production of accelerated electrons by an electron beam device. Electron beam devices are generally well known in the art. For instance, in one embodiment, an electron beam device may be used that is available from Energy Sciences, Inc., of Woburn, Massachusetts under the name "Microbeam LV." Other examples of suitable electron beam devices are described in U.S. Pat. No. 5,003,178 to Livesay; U.S. Pat. No. 5,962,995 to Avnery; U.S. Pat. No. 6,407,492 to Avnery, et al., which are incorporated herein in their entirety by reference thereto for all purposes.

When supplying ionizing radiation, it is generally desired to selectively control various parameters of the radiation to enhance its softening effect on the cellulosic fibers. For example, one parameter that may be controlled is the wavelength $\lambda$ of the ionizing radiation. Specifically, the wavelength $\lambda$ of the ionizing radiation varies for different types of radiation of the electromagnetic radiation spectrum. Although not required, the wavelength $\lambda$ of the ionizing radiation used in the present invention is generally from about $10^{-14}$ meters to about $10^{-5}$ meters. Electron beam radiation, for instance, has a wavelength $\lambda$ of from about $10^{-13}$ meters to about $10^{-9}$ meters.

Besides selecting the particular wavelength $\lambda$ of the ionizing radiation, other parameters may also be selected to enhance the softness of the resulting product. For example, the dosage and energy of the radiation supply may be varied depending on factors such as the desired degree of softening, the nature of the fibrous material, the type of ionizing radiation selected, and the like. For example, higher dosage and energy levels of radiation will typically result in the breaking of a greater number of hydrogen bonds, thereby leading to enhanced softening. It is generally desired that the fibrous material not be "overexposed" to radiation. Such overexposure may result in an unwanted level of product degradation and also result in the yellowing or browning of the fibers. In addition, it is also generally desired that some enough radiation be supplied to provide a softening effect. Thus, in some embodiments, the dosage may range from about 0.1 megarads (Mrads) to about 10 Mrads, and in some embodiments, from about 1 Mrads to about 5 Mrads. In addition, the energy level is typically selected to be at the limit of the vibrational energy of the —OH bonds within the fibrous structure. For example, in some embodiments, the energy level may range from about 0.05 megaelectron volts (MeV) to about 600 MeV.

It should be understood, however, that the actual dosage and/or energy level required depends on the type of fibers and ionizing radiation. Specifically, certain types of fibers may tend to form a lesser or greater number of hydrogen bonds, which will influence the dosage and energy of the radiation utilized. Likewise, certain types of ionizing radiation may be less effective in breaking hydrogen bonds between fibers, and thus may be utilized at a higher dosage and/or energy level. For instance, ionizing radiation that has a relatively high wavelength (lower frequency) may be less efficient in breaking the hydrogen bonds between adjacent cellulosic fibers than ionizing radiation having a relatively low wavelength (higher frequency). Accordingly, in such instances, the desired dosage and/or energy level may be increased to achieve the desired softening affect.

Any of a variety of cellulosic fibrous materials can be used in the present invention. Such materials can include fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designation "Longlac 19".

Hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

The cellulosic fibrous material is formed into a paper web before and/or after being exposed to ionizing radiation. The paper web may be formed according to a variety of papermaking processes known in the art. In fact, any process capable of making a paper web can be utilized in the present invention. For example, a papermaking process of the present invention through-air-drying, uncreped through-air-drying, single recreping, double recreping, can utilize wet-pressing, creping, through-air-drying, creped calendering, embossing, air laying, as well as other steps in processing the paper web. Examples of various papermaking techniques that may be used in the present invention are described in U.S. Pat. Nos. 3,322,617; 3,301,746; 4,158,594; 4,529,480; 4,921,034; and 6,129,815.

In this regard, one particular embodiment for forming a paper web in accordance with the present invention will now be described. Specifically, the embodiment described below relates to one method for forming a paper web utilizing a papermaking technique known as uncreped through-drying. Examples of such a technique are disclosed in U.S. Pat. No. 5,048,589 to Cook. et al.; U.S. Pat. No. 5,399,412 to Sudall, et al.; U.S. Pat. No. 5,510,001 to Hermans, et al.; U.S. Pat. No. 5,591,309 to Rugowski, et al.; and U.S. Pat. No. 6,017,417 to Wendt, et al., which are incorporated herein in their entirety by reference thereto for all purposes. Uncreped through-air drying generally involves the steps of (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

Referring to FIG. 1, one embodiment of a papermaking machine that can be used in the present invention is illustrated. For simplicity, the various tensioning rolls schematically used to define the several fabric runs are shown but not numbered. As shown, a papermaking headbox 10 can be used to inject or deposit a stream of an aqueous suspension of papermaking fibers onto an upper forming fabric 12. The aqueous suspension of fibers is then transferred to a lower forming fabric 13, which serves to support and carry the newly-formed wet web 11 downstream in the process. If desired, dewatering of the wet web 11 can be carried out, such as by vacuum suction, while the wet web 11 is supported by the forming fabric 13. The headbox 10 may be a conventional headbox or may be a stratified headbox capable of producing a multi-layered unitary web. Further, multiple headboxes may be used to create a layered structure, as is known in the art.

The forming fabric 13 can generally be made from any suitable porous material, such as metal wires or polymeric filaments. For instance, some suitable fabrics can include, but are not limited to, Albany 84M and 94M available from Albany International of Albany, N.Y.; Asten 856, 866, 892, 934, 939, 959, or 937; Asten Synweve Design 274, all of which are available from Asten Forming Fabrics, Inc. of Appleton, Wis. Other suitable fabrics may be described in U.S. Pat. No. 6,120,640 to Lindsay, et al. and U.S. Pat. No. 4,529,480 to Trokhan, which are incorporated herein in their entirety by reference thereto for all purposes. Forming fabrics or felts comprising nonwoven base layers may also be useful, including those of Scapa Corporation made with extruded polyurethane foam such as the Spectra Series.

The wet web 11 is then transferred from the forming fabric 13 to a transfer fabric 17 while at a solids consistency of between about 10% to about 35%, and particularly, between about 20% to about 30%. As used herein, a "transfer fabric" is a fabric that is positioned between the forming section and the drying section of the web manufacturing process. In one embodiment, the transfer fabric 17 is a patterned fabric having protrusions or impression knuckles, such as described in U.S. Pat. No. 6,017,417 to Wendt et al. Typically, the transfer fabric 17 travels at a slower speed than the forming fabric 13 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes. During "rush transfer", many of the bonds of the web are believed to be broken, thereby forcing the sheet to bend and fold into the depressions of the surface of the transfer fabric 17. Such molding to the contours of the surface of the transfer fabric 17 can increase the MD stretch of the web 11.

Transfer to the fabric 17 may be carried out with the assistance of positive and/or negative pressure. For example, in one embodiment, a vacuum shoe 18 can apply negative pressure such that the forming fabric 13 and the transfer fabric 17 simultaneously converge and diverge at the leading edge of the vacuum slot. Typically, the vacuum shoe 18 supplies pressure at levels between about 10 to about 25 inches of mercury. As stated above, the vacuum transfer shoe 18 (negative pressure) can be supplemented or replaced by the use of positive pressure from the opposite side of the web to blow the web onto the next fabric. In some embodiments, other vacuum shoes can also be used to assist in drawing the fibrous web 11 onto the surface of the transfer fabric 17.

From the transfer fabric 17, the fibrous web 11 is then transferred to the through-drying fabric 19. When the wet web 11 is transferred to the fabric 19, it can become molded into the shape of the surface of the fabric 19. Specifically, the fabric 19 is typically a permeable fabric having a three-dimensional surface contour sufficient to impart substantial z-directional deflection of the web 11.

For instance, in some embodiments, the side of the through-drying fabric 19 that contacts the wet web 11 can possess between about 10 to about 200 machine-direction (MD) knuckles per inch (mesh) and between about 10 to about 200 cross-direction (CD) strands per inch (count). The diameter of such strands may, for example, be less than about 0.050 inches. Further, in some embodiments, the distance between the highest point of the MD knuckle and the highest point of the CD knuckle is from about 0.001 inches to about 0.03 inches. In between these two levels, knuckles can be formed by MD and/or CD strands that give the topography a 3-dimensional hill/valley appearance that is imparted to the sheet during the wet molding step. Some commercially available examples of such contoured fabrics include, but are not limited to, Asten 934, 920, 52B, and Velostar V800 made by Asten Forming Fabrics, Inc. Other examples of such fabrics may be described in U.S. Pat. No. 6,017,417 to Wendt et al. U.S. Pat. No. 5,492,598 to Hermans, et al., and copending U.S. application Ser. No. 10/015,837 to Burazin, et al., which was filed on Nov. 2, 2001 and is owned by the assignee of the present invention.

While supported by the through-drying fabric 19, the web 11 is then dried by a through-dryer 21 to a solids consistency of about 95% or greater. The through-dryer 21 accomplishes the removal of moisture from the web 11 by passing air therethrough without applying any mechanical pressure. Through-drying can also increase the bulk and softness of the web 11. In one embodiment, for example, the through-dryer 21 can contain a rotatable, perforated cylinder and a hood for receiving hot air blown through perforations of the cylinder as the through-drying fabric 19 carries the web 11 over the upper portion of the cylinder. The heated air is forced through the perforations in the cylinder of the through-dryer 21 and removes the remaining water from the web 11. The temperature of the air forced through the web 11 by the through-dryer 21 can vary, but is typically from about 120° C. to about 260° C. It should also be understood that other non-compressive drying methods, such as microwave or infrared heating, can be used. Moreover, if desired, certain compressive heating methods, such as Yankee dryers, may be used as well.

The web 11 may be exposed to ionizing radiation at one or more locations of the papermaking process. Both surfaces of the web 11 may be exposed to radiation to provide enhanced softness thereto. Alternatively, only one surface of the web 11 may be exposed to radiation if desired. Moreover, although the web 11 may be exposed to ionizing radiation prior to and/or during drying, it is particularly desired that the web 11 is exposed to ionizing radiation after drying, such as at a location 50 using an electron beam device 52. Specifically, the presence of a substantial amount of water within the web 11 may cause slight heating of the web 11 upon radiation exposure. Heating may lead to the production of various malodors associated with heated cellulosic fibers or may lead to various other unwanted consequences. Accordingly, in some embodiments, the web 11 is exposed to ionizing radiation while at a solids consistency of greater than about 90%, in some embodiments greater than about 95%, and in some embodiments, greater than about 98%. It should be understood, however, that the parameters of ionizing radiation exposure may be selected to avoid substantial heating or drying of the web 11, even at a relatively low solids consistencies. In fact, unlike conventional uses of radiation (e.g., infrared radiation) to dry paper webs, one benefit of the present invention is the ability to specifically tailor the radiation exposure to break the hydrogen bonds between cellulosic fibers without causing a substantial number of water molecules present within the web to undergo a phase change from liquid to vapor, thereby substantially drying the web.

If desired, certain compounds may be incorporated into the paper web 11 to enhance its properties. For example, in some embodiments, a wet strength agent can be utilized to further increase the strength of the web 11. As used herein, a "wet strength agent" is any material that, when added to cellulosic fibers, can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Wet strength agents may be applied in various amounts, depending on the desired characteristics of the tissue product. For instance, in some embodiments, the total amount of wet strength agents incorporated into the web 11 can be from about 1 pound per ton (lb/T) to about 60 lb/T, in some embodiments, from about 5 lb/T to about 30 lb/T, and in some embodiments, from about 7 lb/T to about 13 lb/T of the dry weight of fibrous material.

Suitable permanent wet strength agents are typically water soluble, cationic oligomeric or polymeric resins that are capable of either crosslinking with themselves (homocrosslinking) or with the cellulose or other constituents of the wood fiber. Examples of such compounds are described in U.S. Pat. Nos. 2,345,543; 2,926,116; and 2,926,154, which are incorporated herein in their entirety by reference thereto for all purposes. One class of such agents includes polyamine-epichlorohydrin, polyamide epichlorohydrin or polyamide-amine epichlorohydrin resins, collectively termed "PAE resins". Examples of these materials are described in U.S. Pat. No. 3,700,623 to Keim and U.S. Pat. No. 3,772,076 to Keim, which are incorporated herein in their entirety by reference thereto for all purposes and are sold by Hercules, Inc., Wilmington, Del. under the trade designation "Kymene", e.g., Kymene 557H or 557 LX. Kymene 557 LX, for example, is a polyamide epicholorohydrin polymer that contains both cationic sites, which can form ionic bonds with anionic groups on the pulp fibers, and azetidinium groups, which can form covalent bonds with carboxyl groups on the pulp fibers and crosslink with the polymer backbone when cured.

Other suitable materials include base-activated polyamide-epichlorohydrin resins, which are described in U.S. Pat. No. 3,885,158 to Petrovich; U.S. Pat. No. 3,899,388 to Petrovich; U.S. Pat. No. 4,129,528 to Petrovich; U.S. Pat. No. 4,147,586 to Petrovich; and U.S. Pat. No. 4,222,921 to van Eanam, which are incorporated herein in their entirety by reference thereto for all purposes. Polyethylenimine resins may also be suitable for immobilizing fiber-fiber bonds. Another class of permanent-type wet strength agents includes aminoplast resins (e.g., urea-formaldehyde and melamine-formaldehyde).

If utilized, the permanent wet strength agents can be incorporated into the web 11 in an amount from about 1 lb/T to about 20 lb/T, in some embodiments, from about 2 lb/T to about 10 lb/T, and in some embodiments, from about 3 lb/T to about 6 lb/T of the dry weight of fibrous material.

Temporary wet strength agents can also be used in the present invention. Suitable temporary wet strength agents can be selected from agents known in the art such as dialdehyde starch, polyethylene imine, mannogalactan gum, glyoxal, and dialdehyde mannogalactan. Also useful are glyoxylated vinylamide wet strength resins as described in U.S. Pat. No. 5,466,337 to Darlington, et al., which is incorporated herein in its entirety by reference thereto for all purposes. Useful water-soluble resins include polyacrylamide resins such as those sold under the Parez trademark, e.g., Parez 631NC, sold by Cytec Industries, Inc. of Stanford, Conn. Such resins are generally described in U.S. Pat. No. 3,556,932 to Coscia, et al. and U.S. Pat. No. 3,556,933 to Williams, et al., which are incorporated herein in their entirety by reference thereto for all purposes. The "Parez" resins typically include a polyacrylamide-glyoxal polymer that contains cationic hemiacetal sites that can form ionic bonds with carboxyl or hydroxyl groups present on the cellulosic fibers. These bonds can provide increased strength to the web of pulp fibers. In addition, because the hemiacetal groups are readily hydrolyzed, the wet strength provided by such resins is primarily temporary.

U.S. Pat. No. 4,605,702 to Guerro, et al., which is incorporated herein in its entirety by reference thereto for all purposes, also describes suitable temporary wet strength resins made by reacting a vinylamide polymer with glyoxal, and then subjecting the polymer to an aqueous base treatment. Similar resins are also described in U.S. Pat. No. 4,603,176 to Bjorkquist, et al.; U.S. Pat. No. 5,935,383 to Sun, et al.; and U.S. Pat. No. 6,017,417 to Wendt, et al., which are incorporated herein in their entirety by reference thereto for all purposes.

The temporary wet strength agents are generally provided by the manufacturer as an aqueous solution and, in some embodiments, are incorporated into the web 11 in an amount from about 1 lb/T to about 60 lb/T, in some embodiments, from about 3 lb/T to about 40 lb/T, and in some embodiments, from about 4 lb/T to about 15 lb/T of the dry weight of fibrous material. If desired, the pH of the pulp can be adjusted prior to adding the resin. The Parez resins, for example, are typically used at a pH of from about 4 to about 8.

As described above, exposure to ionizing radiation can result in enhanced softening of the web 11 without the use of conventional chemical debonders. Nevertheless, if desired, conventional chemical debonders may sometimes be incorporated into the web 11 to further enhance the softness characteristics. For example, in some embodiments, the debonder can be incorporated into the web 11 in an from about 1 lb/T to about 30 lb/T, in some embodiments from about 3 lb/T to about 20 lb/T, and in some embodiments, from about 6 lb/T to about 15 lb/T of the dry weight of fibrous material.

Any chemical compound that that is capable of enhancing the soft feel of a web when applied thereto may generally be used as a chemical debonder in the present invention. Some examples of suitable debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty & carboxylic acid derivatives, mono- and polysaccharide derivatives, polyhydroxy hydrocarbons, etc. Suitable debonders are also described in U.S. Pat. No. 5,716,498 to Jenny, et al.; U.S. Pat. No. 5,730,839 to Wendt, et al.; U.S. Pat. No. 6,211,139 to Keys, et al.; U.S. Pat. No. 5,543,067 to Phan, et al.; and WO/0021918, which are incorporated herein in their entirety by reference thereto for all purposes. For instance, Jenny, et al. and Phan, et al. describe various ester-functional quaternary ammonium debonders (e.g., quaternized fatty acid trialkanolamine ester salts) suitable for use in the present invention. In addition, Wendt, et al. describes imidazolinium quaternary debonders that may be suitable for use in the present invention. Further, Keys, et al. describes polyester polyquaternary ammonium debonders that may be useful in the present invention. Still other suitable debonders are disclosed in U.S. Pat. No. 5,529,665 to Kaun and U.S. Pat. No. 5,558,873 to Funk, et al., which are incorporated herein in their entirety by reference thereto for all purposes.

After being exposed to ionizing radiation, the resulting web 11 may then be converted into a paper product, such as by being wound into a roll or stacked. The resulting paper product can be a single-layered or multi-layered (i.e., stratified) paper web exposed to ionizing radiation. Alternatively, the paper product can be a multi-ply product (e.g., more than one paper web) in which one or more of the plies contains a web that has been exposed to ionizing radiation. Normally, the basis weight of the paper web and/or a paper product containing the paper web is less than about 120 grams per square meter (gsm), in some embodiments less than about 70 grams per square meter, and in some embodiments, from about 10 to about 60 gsm.

In other embodiments, cellulosic fibers treated with ionizing radiation according to the present invention may be combined with other materials to form the paper product. In such instances, the cellulosic fibers may be treated with ionizing radiation before and/or after being combined with such other materials. For example, in one embodiments, a hydroentangled nonwoven composite web is exposed to ionizing radiation in accordance with the present invention. A typical hydroentangling process utilizes high pressure jet streams of water to entangle fibers and/or filaments to form a highly entangled consolidated fibrous structure, e.g., a nonwoven fabric. Hydroentangled nonwoven fabrics of staple length fibers and continuous filaments are disclosed, for example, in U.S. Pat. No. 3,494,821 to Evans and U.S. Pat. No. 4,144,370 to Bouolton, which are incorporated herein in their entirety by reference thereto for all purposes. Hydroentangled composite nonwoven fabrics of a continuous filament nonwoven web and a pulp layer are disclosed, for example, in U.S. Pat. No. 5,284,703 to Everhart, et al. and U.S. Pat. No. 6,315,864 to Anderson, et al., which are incorporated herein in their entirety by reference thereto for all purposes. Thus, in one embodiment, a continuous filament nonwoven web may be hydroentangled with a pulp layer, and thereafter exposed to ionizing radiation in accordance with the present invention.

As a result of the present invention, it has been discovered that a paper-based product can be formed to have a variety of improved characteristics. Specifically, it has been discovered that softness can be improved (e.g., reduced stiffness) by exposing cellulosic fibers to ionizing radiation. Further, by controlling the ionizing radiation exposure within certain parameters, the improved softness can be achieved without substantially affecting other characteristics of the resulting product.

The present invention may be better understood with reference to the following example.

EXAMPLE

The ability to enhance the softness of a paper web with exposure to ionizing radiation was demonstrated. Uncreped through-dried paper web samples A–D were produced using the method as substantially described above and illustrated in FIG. 1. The paper webs were single-layered and contained 41 wt. % recycled fibers, 15 wt. % southern softwood kraft fibers, and 36 wt. % northern softwood kraft fibers. The basis weight of each web was approximately 25 pounds per 2,880 square feet (42.4 grams per square meter).

After forming the webs, the upper and lower surfaces of samples A–C were treated with electron beam radiation. The electron beam device used to provide the radiation was "Microbeam LV", which is available from Energy Sciences, Inc., of Wobum, Mass. The wavelength of the radiation was between $10^{-12}$ and $10^{-11}$ meters. The dosage, energy level, and current of the electron beam radiation are shown below in Table 1.

TABLE 1

Electron Beam Radiation Characteristics

| Sample | Dosage (Mrads) | Energy Level (kilovolts) | Electron Beam Current (amps) |
|---|---|---|---|
| A | 1 | 125 | 40 |
| B | 5 | 125 | 170 |
| C | 10 | 125 | 290 |
| D (control) | 0 | 0 | 0 |

Upon exposure to the desired level of radiation, the tensile strength and breaking length were tested as set forth below.

Tensile Strength

Tensile strength was reported as "GMT" (grams per 3 inches of a sample), which is the geometric mean tensile strength and is calculated as the square root of the product of MD tensile strength and CD tensile strength. MD and CD tensile strengths were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4 inch gauge length for facial tissue and 2 inch gauge length for bath tissue. The crosshead speed during the test was 10 in./minute. The tester was connected with a computer loaded with data acquisition system; e.g., MTS TestWork for windows software. Readings were taken directly from a computer screen readout at the point of rupture to obtain the tensile strength of an individual sample.

Breaking Length

As used herein, the term "breaking length" (hereinafter may be referred to as "GMBL") is the measurement of the strength of a material, generally a fabric or nonwoven web, and may be reported in length measurements, such as meters. The geometric mean breaking length is calculated by dividing the geometric mean tensile strength by the basis weight of the material. Larger geometric mean breaking length values generally relate to stronger materials.

The results are set forth below in Table 2.

TABLE 2

Strength Comparison of Samples A–D

| Sample | Basis Weight (lb/2880 ft$^2$) | GMT (g/3 inches) | GMBL (meters) |
|---|---|---|---|
| A | 25.1 | 4801 | 1482 |
| B | 25.7 | 4673 | 1408 |
| C | 25.7 | 3779 | 1149 |
| D (control) | 26.4 | 5191 | 1522 |

The softness of the samples were also tested as described below.

Softness

The relative softness of the samples was determined by a panel of between 20 to 30 members. The panelists ranked softness based on a preference in paired comparisons between the subject sample and a reference sample. The percentage of panelists who preferred the softness of the subject sample was then determined. The results are set forth below in Table 3 (e.g., 93% of the panelists preferred the softness of Sample B to the softness of Sample D).

TABLE 3

Softness Comparison of Samples A–D*

| Sample | A | B | C | D (control) |
|---|---|---|---|---|
| A | N/A | 44% | 64% | 64% |
| B | 56% | N/A | 38% | 93% |
| C | 50% | 62% | N/A | 86% |
| D (control) | 36% | 7% | 14% | N/A |

*The data represents the percentage of panelists who preferred the softness of the sample in a given row to the sample in a corresponding column (e.g., 93% of the panelists preferred the softness of Sample B to the softness of Sample D).

Thus, as indicated above, the softness of a paper web can be enhanced by exposure to ionizing radiation. For instance, as shown in Table 3, 86% of the panelists preferred the softness of Sample C (exposure to radiation at 10 Mrads) to the softness of the control Sample D. Moreover, as indicated in Table 2, the strength also decreased with exposure to ionizing radiation, which further indicates an increase in the softness of the sample.

Figure 2:
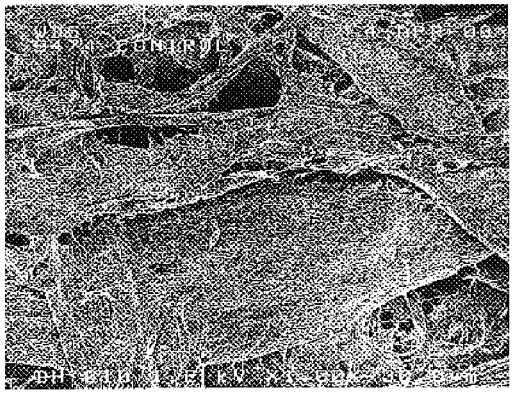
FIG. 2 depicts Field Emission Scanning Electron Microscopy (FESEM) photographs (magnification of 1,000×) of the paper web samples A–D formed in the Example.
Figure 2:
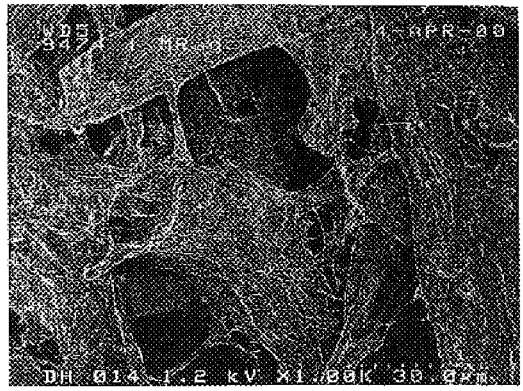
Figure 2:
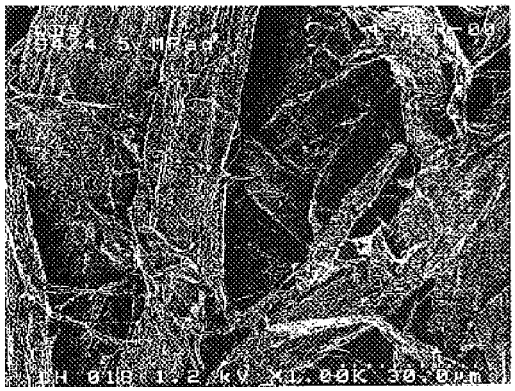
Figure 2:
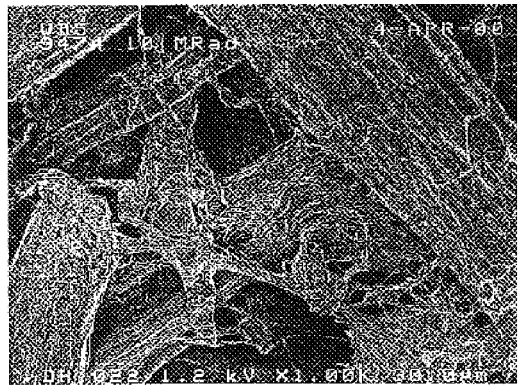
Figure 3:
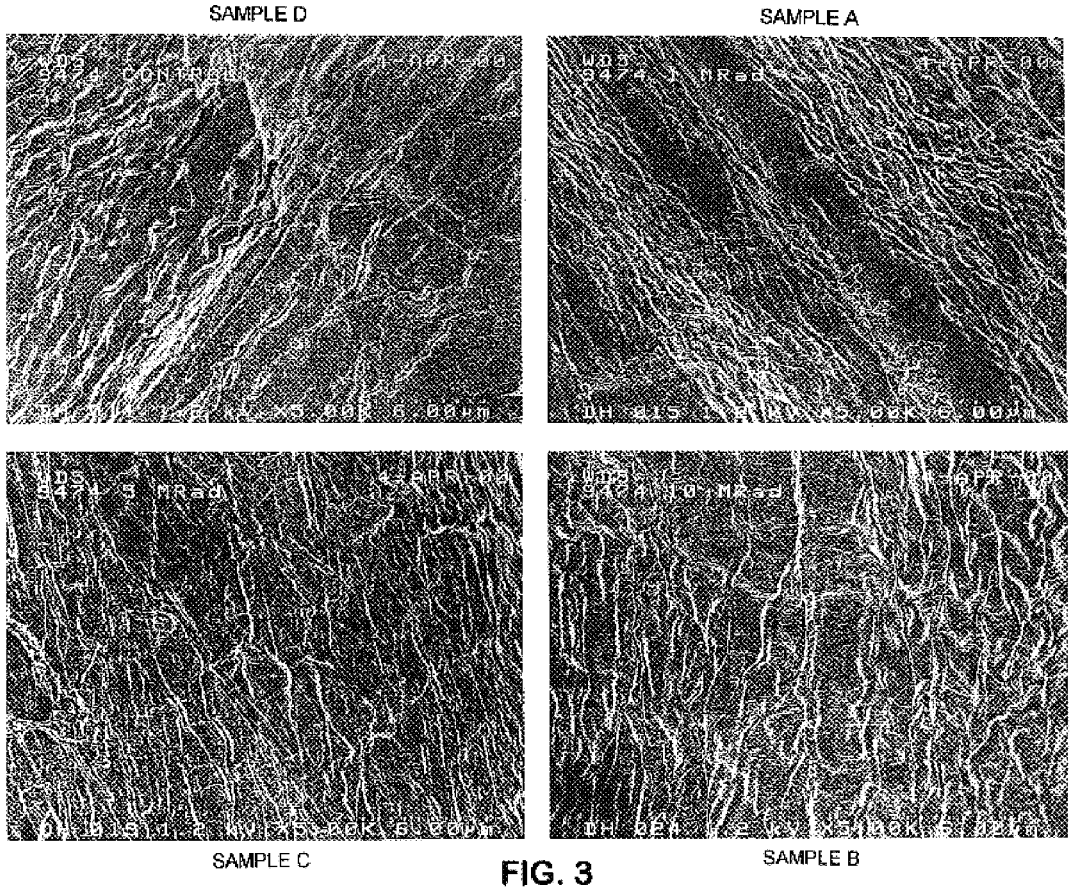
FIG. 3 depicts Field Emission Scanning Electron Microscopy (FESEM) photographs (magnification of 5,000×) of the paper web samples A–D formed in the Example.
Figure 4:
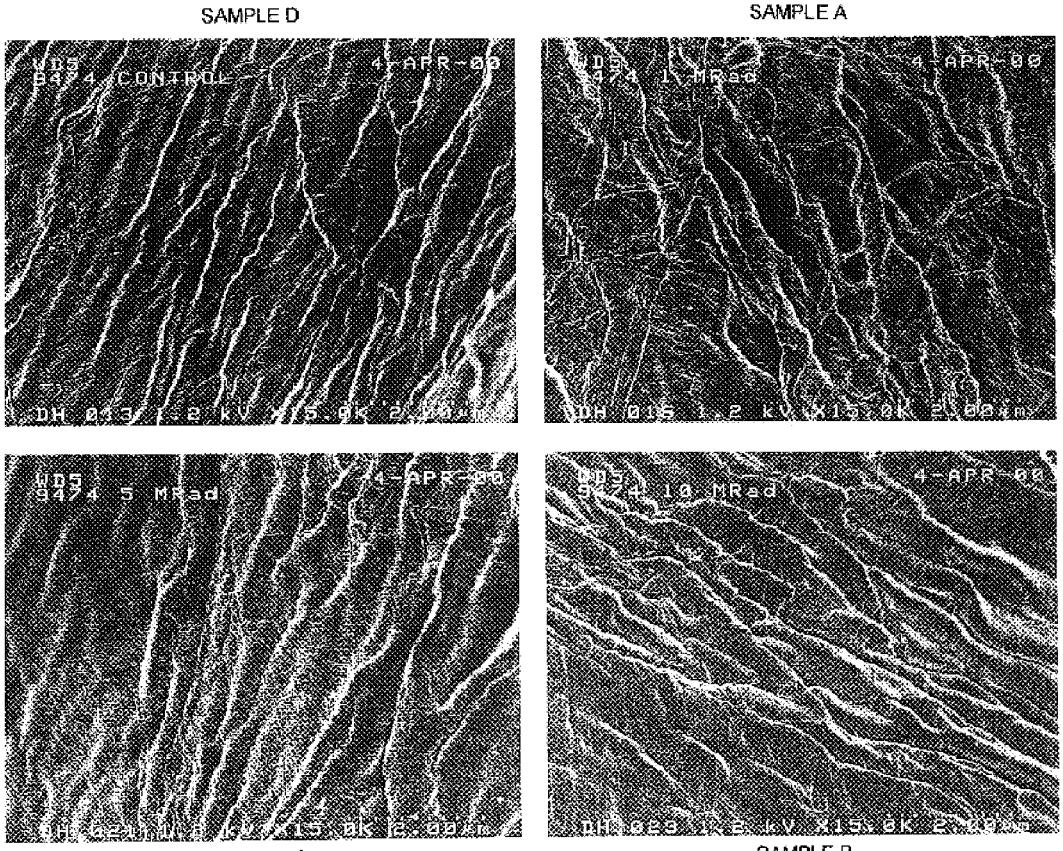
FIG. 4 depicts Field Emission Scanning Electron Microscopy (FESEM) photographs (magnification of 15,000×) of the paper web samples A–D formed in the Example.

In addition, "Field Emission Scanning Microscopy" (FESEM) photographs were taken for the samples A–D at a magnification of 1,000×, 5,000×, and 15,000×. FESEM was performed using a Hitachi S-4500 microscopy in high-resolution mode (about 5 millimeter working distance, upper secondary electron detector) and low-resolution mode (about 15 millimeter working distance, lower secondary electron detector). The samples were prepared for high-resolution scanning by sputtering a layer of chromium on the web at a thickness of approximately 10 nanometers. Imaging was conducted with an accelerating voltage of 1.2 kilovolts. The FESEM results are shown in FIGS. 2–4. Referring to FIG. 3, for instance, Samples A–C appear to possess a more open fibrous structure than the control Sample D, which is believed to make the sample feel softer. Although not limited in theory, it is believed that the more open fibrous structure of the samples exposed to ionizing radiation is a result of a variety of factors. First, it is believed that the lesser degree of hydrogen bonding within the treated samples as compared with the control sample allows a more open structure. Further, it is also believed that the ionizing radiation disrupts the cell walls of the fibers, which opens the crystalline structure of the material.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed:

1. A method for softening a cellulosic fibrous material, said method comprising exposing the cellulosic fibrous material to ionizing radiation at a dosage of from about 0.1 megarads to about 10 megarads, said ionizing radiation having a wavelength of from about $10^{-14}$ meters to about $10^{-5}$ meters.

2. A method as defined in claim 1, wherein said ionizing radiation is selected from the group consisting of electron beam radiation, natural and artificial radio isotopes, x-rays, neutron beams, positively-charged beams, laser beams, and combinations thereof.

3. A method as defined in claim 1, wherein said ionizing radiation is electron beam radiation.

4. A method as defined in claim 1, wherein the wavelength of said ionizing radiation is from about $10^{-13}$ meters to about $10^{-9}$ meters.

5. A method as defined in claim 1, wherein the dosage of said ionizing radiation is from about 1 megarads to about 5 megarads.

6. A method as defined in claim 1, wherein said cellulosic fibrous material is incorporated into a paper web.

7. A method as defined in claim 6, wherein said paper web is formed by a through-drying process.

8. A method as defined in claim 6, wherein said paper web is exposed to said ionizing radiation while at a solids consistency of greater than about 90%.

9. A method as defined in claim 6, wherein said paper web is exposed to said ionizing radiation while at a solids consistency of greater than about 95%.

10. A method as defined in claim 6, wherein said paper web is incorporated with a wet strength agent, a chemical debonder, or combinations thereof.

11. A method as defined in claim 6, wherein said paper web is uncreped.

12. A method for softening a paper web, said method comprising exposing one or more surfaces of the paper web to electron beam radiation at a dosage of from about 1 megarads to about 5 megarads, said electron beam radiation having a wavelength of from about $10^{-13}$ meters to about $10^{-9}$ meters.

13. A method as defined in claim 12, wherein said paper web is formed by a through-drying papermaking process.

14. A method as defined in claim 13, wherein said paper web is uncreped.

15. A method as defined in claim 12, wherein said paper web is exposed to said electron beam radiation while at a solids consistency of greater than about 90%.

16. A method as defined in claim 12, wherein said paper web is exposed to said electron beam radiation while at a solids consistency of greater than about 95%.

17. A method for softening a paper web that is formed from a papermaking furnish that contains cellulosic fibers and dried to a solids consistency of greater than about 95%, said method comprising exposing said dried paper web to electron beam radiation at a dosage of from about 0.1 megarads to about 10 megarads.

18. A method as defined in claim 17, wherein the wavelength of said electron beam radiation is from about $10^{-13}$ meters to about $10^{-9}$ meters.

19. A method as defined in claim 17, wherein the dosage of said electron beam radiation is from about 1 megarads to about 5 megarads.

20. A method as defined in claim 17, wherein said paper web is dried with a through-dryer.

21. A method as defined in claim 20, wherein said paper web is formed without creping.

22. A method for forming a paper product, said method comprising:

providing a papermaking furnish that contains cellulosic fibers;

depositing said papermaking furnish onto a forming surface to form a wet web;

drying said wet web to a solids consistency of at least about 90% to form a dried web;

exposing said wet web, said dried web, or combinations thereof, to electron beam radiation at a dosage of from about 1 megarads to about 10 megarads, said electron beam radiation having a wavelength of from about $10^{-13}$ meters to about $10^{-9}$ meters; and converting said dried paper web into the paper product.

23. A method as defined in claim 22, wherein said converting includes winding said dried paper web into a roll.

24. A method as defined in claim 22, wherein said wet web is dried with a through-air dryer.

25. A method as defined in claim 24, wherein said dried paper web is formed without creping.

26. A method as defined in claim 22, wherein said dried paper web is exposed to said electron beam radiation.

27. A method as defined in claim 22, wherein said dried paper web is exposed to said electron beam radiation while at a solids consistency of greater than about 95%.

28. A method as defined in claim 22, wherein the dosage of said electron beam radiation is from about 1 megarads to about 5 megarads.

29. A paper product formed according to the method of claim 1.

30. A paper product formed according to the method of claim 12.

31. A paper product formed according to the method of claim 17.

32. A paper product formed according to the method of claim 22.

* * * * *